US011017926B2

(12) United States Patent
Lee et al.

(10) Patent No.: US 11,017,926 B2
(45) Date of Patent: May 25, 2021

(54) COIL COMPONENT

(71) Applicant: SAMSUNG ELECTRO-MECHANICS CO., LTD., Suwon-Si (KR)

(72) Inventors: Hwan Soo Lee, Suwon-Si (KR); Sung Min Song, Suwon-Si (KR); Yoon Hee Cho, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 303 days.

(21) Appl. No.: 16/017,015

(22) Filed: Jun. 25, 2018

(65) Prior Publication Data

US 2019/0122795 A1 Apr. 25, 2019

(30) Foreign Application Priority Data

Oct. 23, 2017 (KR) ..... 10-2017-0137677

(51) Int. Cl.

| | |
|---|---|
| ***H01F 27/32*** | (2006.01) |
| ***H01F 5/04*** | (2006.01) |
| ***H01F 1/14*** | (2006.01) |
| ***H01F 27/29*** | (2006.01) |
| ***H01F 17/04*** | (2006.01) |
| ***H01F 17/00*** | (2006.01) |

(52) U.S. Cl.

CPC ..... *H01F 5/04* (2013.01); *H01F 1/14* (2013.01); *H01F 17/0013* (2013.01); *H01F 17/04* (2013.01); *H01F 27/292* (2013.01); *H01F 27/32* (2013.01); *H01F 27/323* (2013.01); *H01F 27/324* (2013.01); *H01F 2017/048* (2013.01)

(58) Field of Classification Search

CPC ..... H01F 5/04; H01F 27/292; H01F 17/04; H01F 17/0013; H01F 1/14; H01F 27/32; H01F 27/323; H01F 27/324; H01F 2017/048; H01F 27/28; H01F 27/29

See application file for complete search history.

(56) References Cited

U.S. PATENT DOCUMENTS

2008/0003408 A1 1/2008 Masai et al.
2009/0128275 A1 5/2009 Yagasaki et al.
(Continued)

FOREIGN PATENT DOCUMENTS

CN 103180919 A 6/2013
CN 104103398 A 10/2014
(Continued)

OTHER PUBLICATIONS

Korean Office Action dated Dec. 3, 2018 issued in Korean Patent Application No. 10-2017-0137677 (with English translation).
(Continued)

*Primary Examiner* — Tuyen T Nguyen
(74) *Attorney, Agent, or Firm* — Morgan, Lewis & Bockius LLP

(57) ABSTRACT

A coil component includes a body including a coil including lead portions at both ends thereof and a magnetic material sealing the coil and external electrodes disposed on outer surfaces of the body and connected to the lead portions, respectively. An outer surface of the coil including at least one of an upper surface, a lower surface, and a side surface of the coil includes a surface area increasing portion.

20 Claims, 12 Drawing Sheets

(56) References Cited

U.S. PATENT DOCUMENTS

| | | | | |
|---|---|---|---|---|
| 2013/0222101 | A1* | 8/2013 | Ito | H01F 5/003 336/83 |
| 2014/0009254 | A1 | 1/2014 | Ohkubo et al. | |
| 2014/0306792 | A1 | 10/2014 | Yoneda et al. | |
| 2015/0048920 | A1* | 2/2015 | Lee | H01F 41/041 336/219 |

FOREIGN PATENT DOCUMENTS

| | | | |
|---|---|---|---|
| CN | 104810131 | A | 7/2015 |
| JP | 2008-010783 | A | 1/2008 |
| JP | 2010-045126 | A | 2/2010 |
| JP | 5084459 | B2 | 11/2012 |
| KR | 10-2014-0009254 | A | 1/2014 |
| KR | 10-1483876 | B1 | 1/2015 |
| KR | 10-2015-0089163 | A | 8/2015 |

OTHER PUBLICATIONS

Office Action issued in corresponding Chinese Patent Application No. 201811182529.4 dated Nov. 4, 2020, with English translation.

* cited by examiner

COIL COMPONENT

CROSS-REFERENCE TO RELATED APPLICATION

This application claims the benefit of priority to Korean Patent Application No. 10-2017-0137677 filed on Oct. 23, 2017, in the Korean Intellectual Property Office, the disclosure of which is incorporated herein by reference in its entirety.

TECHNICAL FIELD

The present disclosure relates to a coil component and, more particularly, to a power inductor capable of controlling self-resonant frequency (SRF).

BACKGROUND

As application coverage of wireless power transmission technologies is expanded, improving the efficiency of power amplifiers is an important issue. An envelope tracking (ET) technique using active voltage control is at the forefront of such technologies, and in order to obtain an effect of minimizing an energy waste using the ET technique, an impedance value of a desired frequency band is a major performance index in a power inductor at an ET output terminal. In the case of the power inductor, as a current value required in electronic devices is increased, and metal-based power inductors having an excellent DC bias characteristics (Isat) are increasingly employed.

Generally, in order to change a self-resonant frequency (SRF) and impedance required in devices or applications, a material of an inductor or a shape of an electrode is required to be changed. However, as inductors are increasingly reduced in size, it is not easy to tune the SRF and impedance, and when a material and a shape of an electrode is changed, product reliability, fixing strength at the time of mounting, and the like, are also required to be considered.

SUMMARY

An aspect of the present disclosure may provide a power inductor which has a bead function and is capable of controlling a self-resonant frequency (SRF).

According to an aspect of the present disclosure, a coil component may include: a body including a coil including lead portions at both ends thereof and a magnetic material sealing the coil; and external electrodes disposed on outer surfaces of the body and connected to the lead portions, respectively. At least a portion of outer surfaces of the coil including at least one of an upper surface, a lower surface, and a side surface of an outermost coil pattern of the coil includes a surface area increasing portion.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
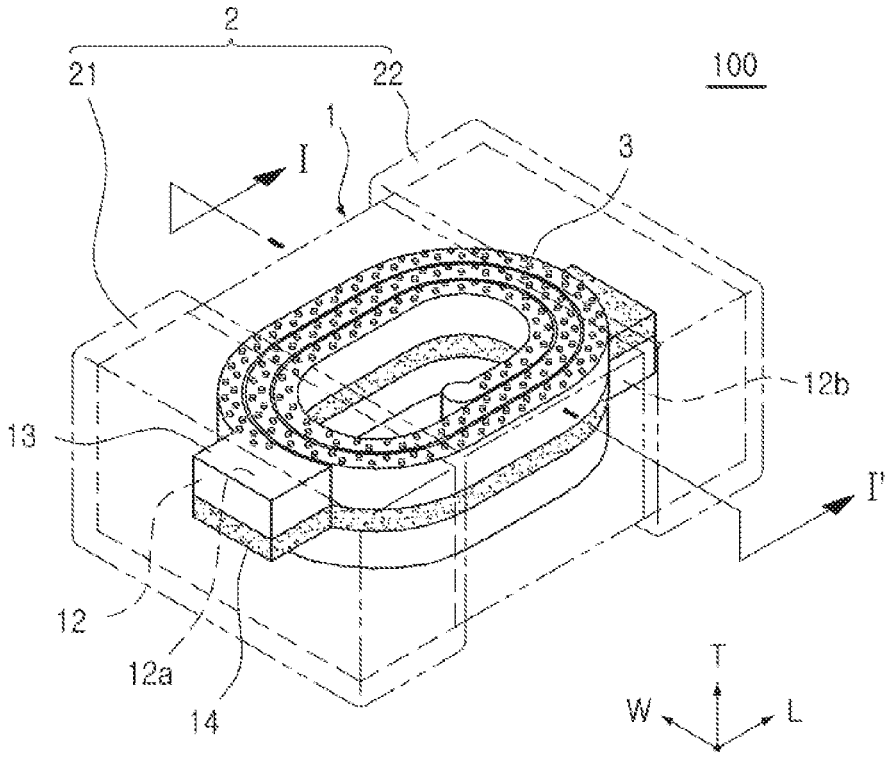
FIG. 1 is a schematic perspective view of a coil component according to a first exemplary embodiment in the present disclosure.

Exemplary embodiments of the present disclosure will now be described in detail with reference to the accompanying drawings. In the accompanying drawings, shapes, sizes, and the like, of components may be exaggerated or stylized for clarity.

The present disclosure may, however, be exemplified in many different forms and should not be construed as being limited to the specific embodiments set forth herein. Rather these embodiments are provided so that this disclosure will be thorough and complete, and will fully convey the scope of the disclosure to those skilled in the art.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

The meaning of a "connection" of a component to another component in the description includes an indirect connection through a third component as well as a direct connection between two components. In addition, "electrically connected" means the concept including a physical connection and a physical disconnection. It can be understood that when an element is referred to with "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

Herein, an upper portion, a lower portion, an upper side, a lower side, an upper surface, a lower surface, and the like, are decided in the accompanying drawings. For example, a first connection member is disposed on a level above a redistribution layer. However, the claims are not limited thereto. In addition, a vertical direction refers to the above-mentioned upward and downward directions, and a horizontal direction refers to a direction perpendicular to the above-mentioned upward and downward directions. In this case, a vertical cross section refers to a case taken along a plane in the vertical direction, and an example thereof may be a cross-sectional view illustrated in the drawings. In addition, a horizontal cross section refers to a case taken along a plane in the horizontal direction, and an example thereof may be a plan view illustrated in the drawings.

Terms used herein are used only in order to describe an exemplary embodiment rather than limiting the present disclosure. In this case, singular forms include plural forms unless interpreted otherwise in context.

Hereinafter, a coil component according to an exemplary embodiment in the present disclosure will be described, but the present disclosure is not limited thereto.

First Exemplary Embodiment

Figure 2:
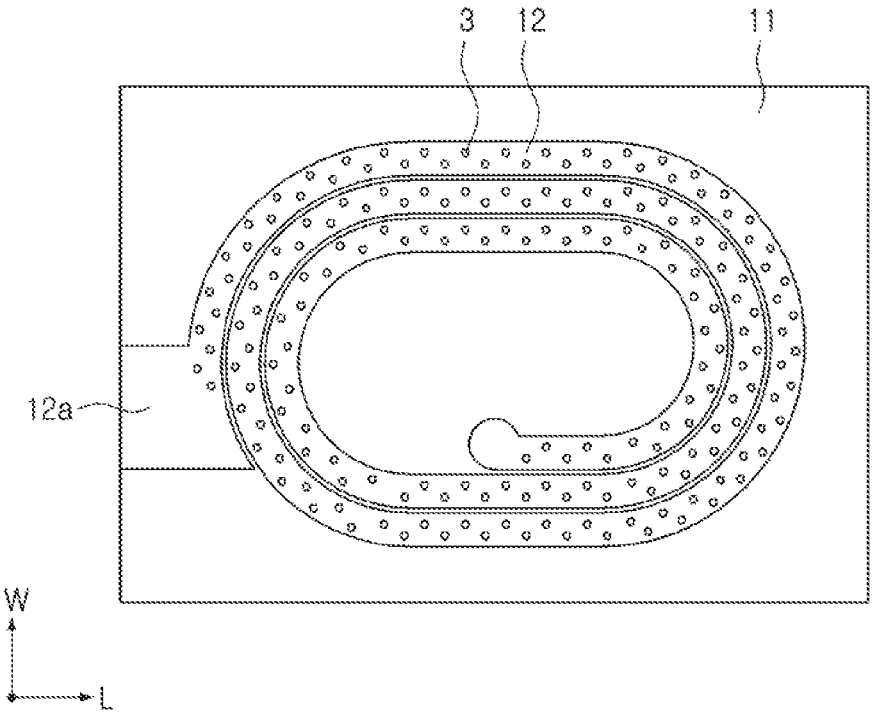
FIG. 2 is a top plan view of a coil of FIG. 1.
Figure 3:
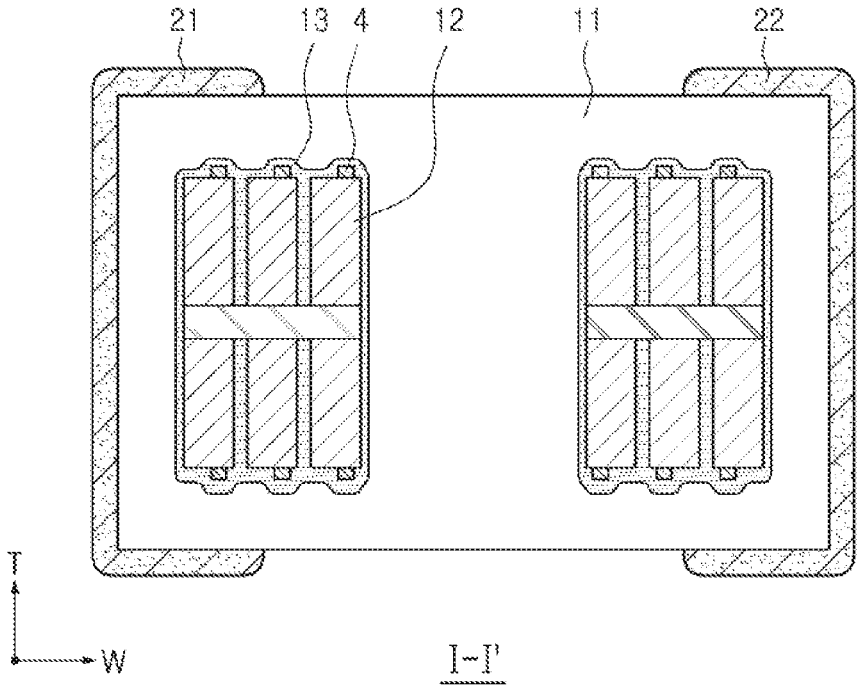
FIG. 3 is a cross-sectional view, taken along line I-I' of FIG. 1.

FIG. 1 is a schematic perspective view of a coil component according to a first exemplary embodiment in the present disclosure, FIG. 2 is a top plan view of a coil of the coil component of FIG. 1, and FIG. 3 is a cross-sectional view, taken along line I-I' of FIG. 1.

Referring to FIGS. 1 through 3, a coil component 100 according to a first exemplary embodiment includes a body 1 and external electrodes 2 disposed on outer surfaces of the body 1.

The body 1 forms an overall appearance of a coil component. The body 1 includes an upper surface and a lower surface opposing each other in the thickness direction T, a first end surface and a second end surface opposing each other in the length direction L, and a first side surface and a second side surface opposing each other in the width direction W. The body 1 may have a substantially hexahedral shape but is not limited thereto.

The external electrode 2 disposed on the outer surfaces of the body 1 includes a first external electrode 21 and a second external electrode 22 facing each other in the length direction of the body 1. The first and second external electrodes may have a shape of alphabet C but may also be configured as an L-shaped electrode or a bottom electrode as necessary by those skilled in the art.

Since the external electrodes 2 are to electrically connect a coil 12 and an external electronic component, the external electrodes 2 may be formed of a material having excellent electrical conductivity. The external electrodes 2 may have a plurality of layers including a metal epoxy-containing layer, a Ni containing layer, and a Sn containing layer.

A magnetic material 11 determining a shape of the body 1 seals the coil. Here, inductance of the coil component may be enhanced using a magnetic material having high magnetic permeability, and a position of a self-resonant frequency (SRF) may be adjusted by controlling permittivity of the magnetic material. Also, magnetic particles included in the magnetic material may have both coarse powder and the fine powder mixed in a predetermined ratio and may have a structure of a bi-modal or tri-modal structure by differentiating sizes of the particles. The magnetic material 11 may have a structure in which Fe—Cr—Si-based amorphous magnetic particles are dispersed in an epoxy-based polymer matrix. An average particle size of the magnetic particles is not limited but may be generally controlled to range from about 1 μm to about 3 μm.

The outer surface of the body 1 may be selectively insulated (not shown). This is because it is advantageous to insulate the surface to reduce AC leakage in a high frequency band (typically 1 MHz to SRF section) during a PMIC operation. Here, an epoxy-based polymer may be used for the surface insulation and a thickness of the insulated surface may be about 5 μm or greater to ensure insulation reliability. The coil 12 may be spiral-shaped overall by the magnetic material of the body 1. The coil 12 includes lead portions 12*a* and 12*b* connecting the coil 12 to the external electrodes 21 and 22 at both ends thereof. The lead portions includes a first lead portion 12*a* connected to the first external electrode 21 and a second lead portion 12*b* connected to the second external electrode 22.

The coil 12 is supported by a support member 14, and any suitable material may be used as a material of the support member 14 without limitation as long as it has insulation properties and mechanical strength for supporting the coil. For example, copper clad laminate (CCL) may be used.

The surface of the coil 12 is surrounded by an insulating material 13. The insulating material is not disposed on side surfaces of the first and second lead portions 12*a* and 12*b* in contact with the first and second external electrodes 21 and 22 among surfaces of the coil 12.

A method of forming the insulating material 13 is not limited. For example, a chemical vapor deposition (CVD) method, a sputtering method, a method of laminating an insulating sheet, and the like, may be applied without limitation. For example, when CVD is used, an insulating material including a perylene resin may be applied as an insulating material having excellent insulation properties and processing characteristics, and here, a person skilled in the art may appropriately select an insulating material according to methods of forming the insulator.

A thickness of the insulating material 13 is not limited but it is necessary to determine the thickness of the insulating material in consideration of a specification value of a coil component required by a person skilled in the art because an electrical characteristic value changes depending on the thickness of the insulating material. If the thickness of insulation material increases, Ls (inductance) tends to decrease but SRF increases at a rate greater than a rate at which Ls decreases. Based on this, it can be seen that the SRF value may be controlled by controlling the thickness of the insulation material.

However, referring to Table 1 below, since an impedance value of a specific frequency is also changed as the insulation thickness is changed, the insulation thickness is required to be appropriately set to optimize the SRF characteristic, the impedance value, and the Ls value. The model of the coil component of Table 1 is a 2016 size (length× width: 2.0 mm×1.6 mm), thickness 0.8 μm, and 1.0 μH.

TABLE 1

| Insulation thickness | Z[Ω]@50 MHz | | | | Z[Ω]@100 MHz | | | | Z[Ω]@130 MHz | | | |
|---|---|---|---|---|---|---|---|---|---|---|---|---|
| (μm) | Min | Max | Avg | Std | Min | Max | Avg | Std | Min | Max | Avg | Std |
| 3 | 618 | 723 | 661 | 27.59 | 429 | 495 | 449 | 19.68 | 269 | 301 | 279 | 9.37 |
| 6 | 479 | 523 | 498 | 14.84 | 721 | 848 | 805 | 39.24 | 388 | 433 | 418 | 13.34 |

TABLE 1-continued

| Insulation thickness | Z[Ω]@50 MHz | | | | Z[Ω]@100 MHz | | | | Z[Ω]@130 MHz | | | |
|---|---|---|---|---|---|---|---|---|---|---|---|---|
| (μm) | Min | Max | Avg | Std | Min | Max | Avg | Std | Min | Max | Avg | Std |
| 9 | 376 | 418 | 403 | 12.82 | 1284 | 1675 | 1373 | 115.85 | 607 | 761 | 639 | 46.20 |
| 12 | 365 | 389 | 378 | 8.78 | 8.78 | 1638 | 1698 | 32.56 | 750 | 811 | 787 | 16.11 |

Referring to Table 1, it can be seen that the impedance specification values (300Ω or greater @50 MHz, more than 1500Ω or greater @100 MHz) are satisfied when the insulation thickness of the insulating material is 12 μm. Based on this, it may be determined whether the required SRF value is satisfied when the thickness of the insulating material on the surface of the coil is set to 12 μm, and if the SRF value is satisfied, the thickness of the insulating material may be set to 12 μm.

Referring to FIGS. 1 through 3, a plurality of protrusions 3 are disposed on an upper surface of the coil 12. The plurality of protrusions 3 are surface area increasing portions serving to increase a surface area of the upper surface of the coil 12. Here, the surface area increasing portion refers to a component capable of increasing a surface area in which the outer surface of the coil 12 and the insulating material abut thereon are in contact with each other.

The plurality of protrusions 3 have a circular cross-section with respect to the L-W surface of the body 1 and have a cylindrical shape as a whole. The size and amount of the plurality of protrusions, such as the height of the cylinder and a sectional area of the circular cross-section may only need to be determined in consideration of an SRF value required by a person skilled in the art.

There is no limitation in a method of forming the plurality of protrusions. For example, chemical etching or mechanical etching may be applied without limitation. In the case of chemical etching, roughening (CZ treatment) for roughness may be repeated a plurality of times on the surface, and in the case of mechanical etching, a sandblast method may be applied.

The plurality of protrusions 3 may include the same type of material as that of a material of the coil 12 or may include a material different from that of the coil 12. When the plurality of protrusions 3 are formed of the same material as that of the coil 12, for example, an etching method may be applied. That is, the plurality of protrusions 3 may be formed by removing at least a portion of a surface of the previously prepared coil 12. Meanwhile, if the plurality of the protrusions 3 are formed of a material different from that of the coil 12, the plurality of protrusions 3 may be formed by performing patterning by additionally applying exposure and development and substantially performing plating after the coil is formed.

The plurality of protrusions 3 may serve to strengthen coupling between the coil and the insulating material on the coil through an anchor effect, as well as increasing the surface area of the coil.

Meanwhile, in FIGS. 1 through 3, it is illustrated that a plurality of protrusions are disposed on only the upper surface of the coil 12. However, the plurality of protrusions may also be selectively positioned on the upper surface or the side surface (side surface of the outermost coil pattern) in the outer surfaces of the coil 12 without limitation. Here, arrangement of a plurality of protrusions in a space between adjacent coil patterns in the outer surfaces of the coil 12 is not excluded but it may physically be difficult because a space between the coil patterns is significantly narrow according to miniaturization of coil components.

Since a position of the SRF value of the coil component may be tuned by controlling the shape, size, and arrangement of the plurality of protrusions 3, the position of the SRF value may freely be shifted to a low frequency or a high frequency by adjusting the size, shape, placement and number of the protrusions 3.

Although not shown in detail, the plurality of protrusions 3 may be connected to each other to form a protrusion portion extending along the upper surface of the coil 12, and any modification in which a protrusion portion is formed on the surface of the coil to increase a contact area between the surface of the coil and the insulating material formed thereon may be applied depending on desired characteristic value such as, for example, an SRF value.

Figure 4:
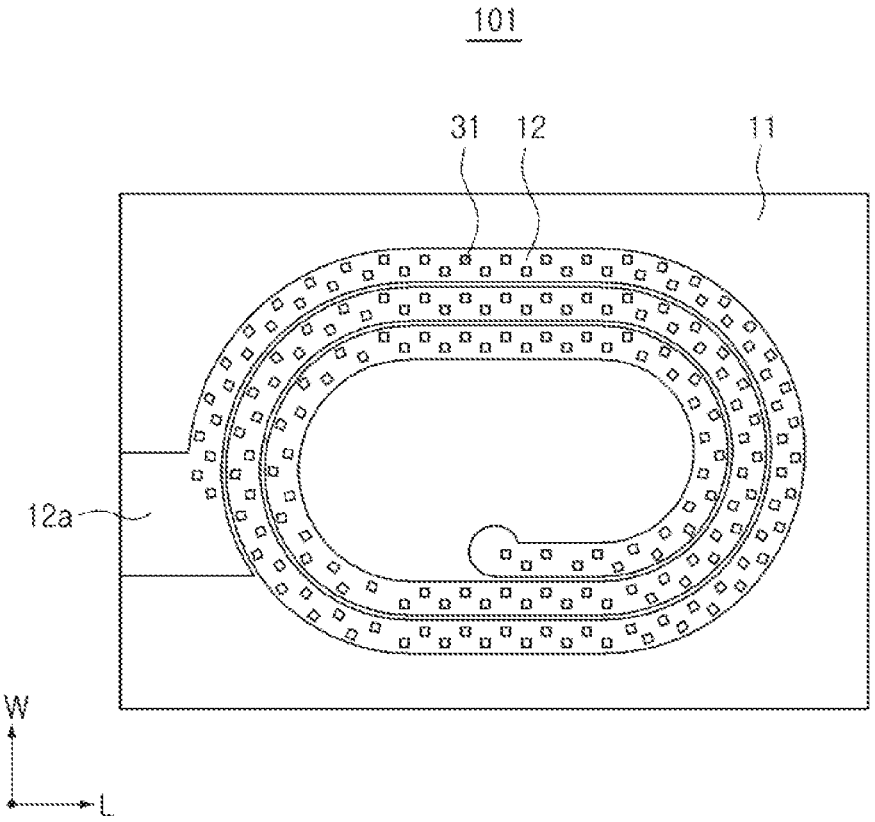
FIG. 4 is a plan view of a coil component according to a first modification of FIG. 3.

FIG. 4 is a plan view of a coil component 101 according to a first modification to the coil component 100 according to the first exemplary embodiment. The coil component 101 according to the first modification is substantially the same as the coil component 100 described above with reference to FIGS. 1 through 3, except for a shape of protrusions, and thus, for the purposes of description, the same reference numerals are used for the same components and a description of the same components will be omitted.

Referring to FIG. 4, protrusions 31 having a rectangular cross-sectional shape are disposed on an upper surface of the coil 12 of the coil component 101. A specific cross-sectional shape and thickness of the plurality of protrusions 31, a size of a sectional area of the plurality of protrusions 31, and an arrangement space between the plurality of protrusions may be appropriately selected in consideration of a desired characteristic value, for example, an SRF value.

Figure 5:
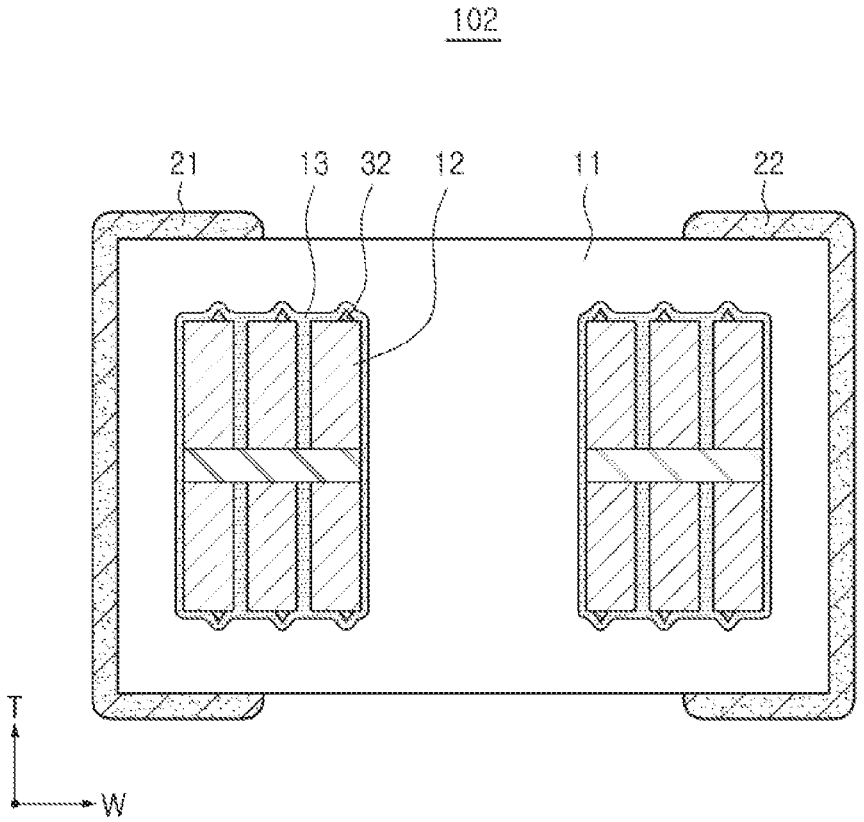
FIG. 5 is a cross-sectional view of a coil component according to a second modification of FIG. 3.

FIG. 5 is a cross-sectional view of a coil component 102 according to a second modification to the coil component 100 according to the first exemplary embodiment. The coil component 102 according to the second modification is substantially the same as the coil component 100 described above with reference to FIGS. 1 through 3, and thus, for the purposes of description, the same reference numerals are used for the same components and a description of the same components will be omitted.

Referring to FIG. 5, protrusions 32 are needle-shaped protrusions. Here, the needle-shaped protrusions may include all shapes in which a sectional area of an upper surface thereof is smaller than that of a lower surface thereof. An uppermost portion of the needle-shaped protrusions not necessarily have a pointed shape and may be curved. The plurality of protrusions 32 may be formed by repeating the CZ treatment a plurality of times but the present disclosure is not limited thereto.

According to the coil components described above with reference to FIGS. 1 through 5, since the plurality of protrusions are arranged on at least a portion of the surface of the coil, the SRF of the coil component may be easily adjusted, whereby the coil component appropriate for utilization in a high frequency region may be advantageously provided.

Figure 6:
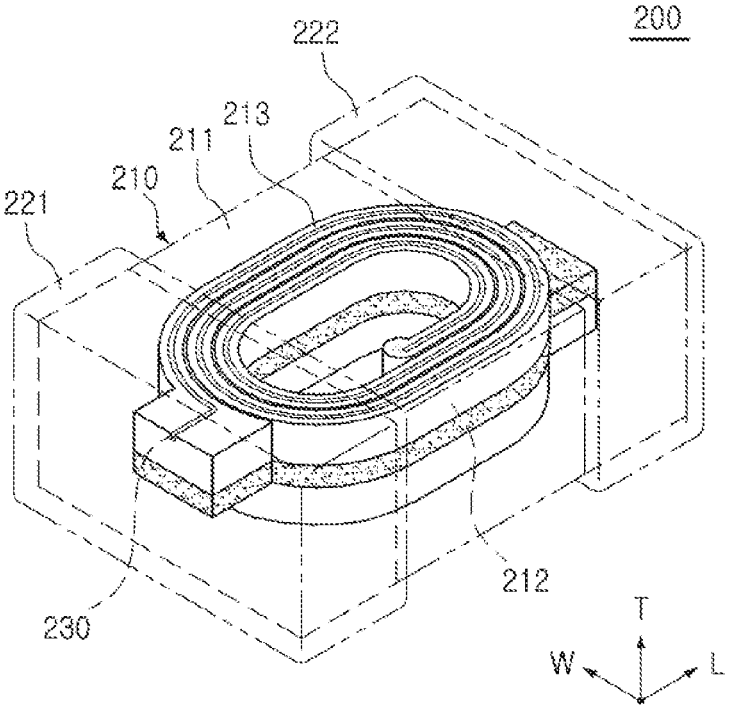
FIG. 6 is a schematic perspective view of a coil component according to a second exemplary embodiment in the present disclosure.
Figure 7:
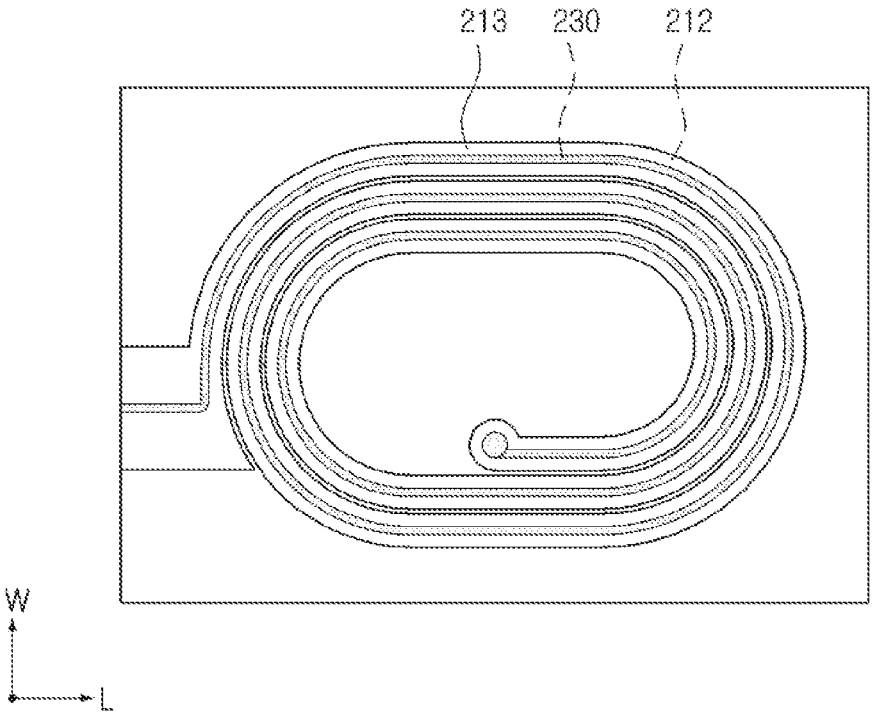
FIG. 7 is a top plan view of the coil of FIG. 6.

FIG. 6 is a schematic perspective view of a coil component 200 according to a second exemplary embodiment in the present disclosure, and FIG. 7 is a top plan view of the coil of FIG. 6.

Referring to FIGS. 6 and 7, the coil component 200 includes a body 210 and first and second external electrodes 221 and 222 on an outer surface of the body 210.

The body 210 includes a coil 212 and a magnetic material 211 for sealing the coil.

A concave portion 230 is formed on an upper surface of the coil 212 and depressed to a predetermined depth from the upper surface of the coil 212, as a surface area increasing portion. The concave portion 230 serves to increase a contact area between an insulating material 213 which covers the surface of the coil 212 to insulate the coil from the magnetic material 211 and the surface of the coil 212. When the contact area between the coil surface and the insulating material increases, the SRF value may be increased, and thus, the contact area is controlled through the groove.

In addition, the concave portion 230 may be filled with a dielectric material instead of the insulating material 213, and a structure in which the concave portion 230 is filled with the dielectric material and the insulating material 213 is disposed thereon.

The concave portion 230 extends in a direction in which the coil is wound. There is no limitation in a formation method thereof, but, for example, a method of additionally laminating a dry film in the process of forming the coil, forming a pattern corresponding to a shape of the coil through exposure and development, and subsequently performing plating on the pattern may be adopted. Alternatively, a method of removing a portion of the surface of the coil in a winding direction of the coil by applying laser beam machining to the surface of the coil may be used.

In FIGS. 6 and 7, it is illustrated that the concave portion is formed only on the upper surface of the coil, but the concave portion may also be formed on a side surface, as well as on the upper surface, in the outer surface of the coil, and a size of a width and depth of the concave portion may be appropriately selected.

Figure 8:
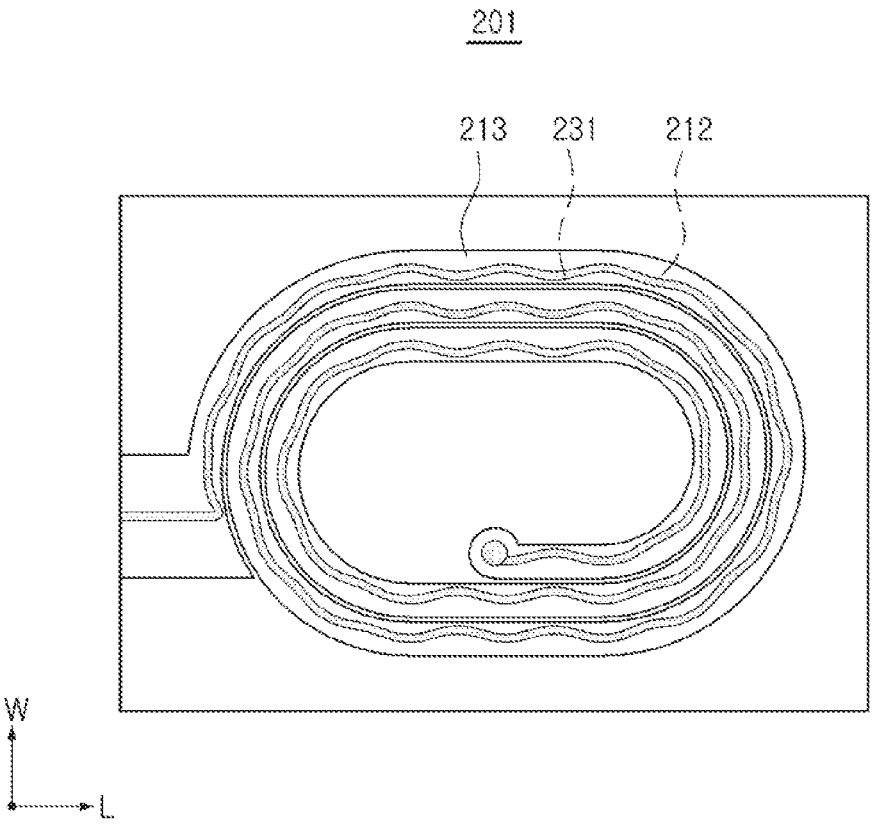
FIG. 8 is a cross-sectional view of a coil component according to a first modification of FIG. 6.

FIG. 8 is a top view of a coil component 201 according to a first modification to the coil component 200. The coil component 201 of FIG. 8 is substantially the same as the coil component 200 described above with reference to FIGS. 6 and 7, except for an extending scheme of the concave portion, and thus, for the purposes of description, the same reference numerals are used for the same components and a description of the same components will be omitted.

Referring to FIG. 8, the coil component 201 is provided with a concave portion 231 extending in a winding direction of the coil 212 and formed to have a meandering shape on the upper surface of the coil 212. The concave portion 231 has a larger contact area with the insulating material disposed thereon than the concave portion 230 disposed on the upper surface of the coil 212 of the coil component 200 illustrated in FIG. 7, having a greater range for increasing the SRF. The SRF may be increased or decreased by adjusting the degree of meandering of the concave portion 231 or by controlling a length or depth of the concave portion.

Figure 9:
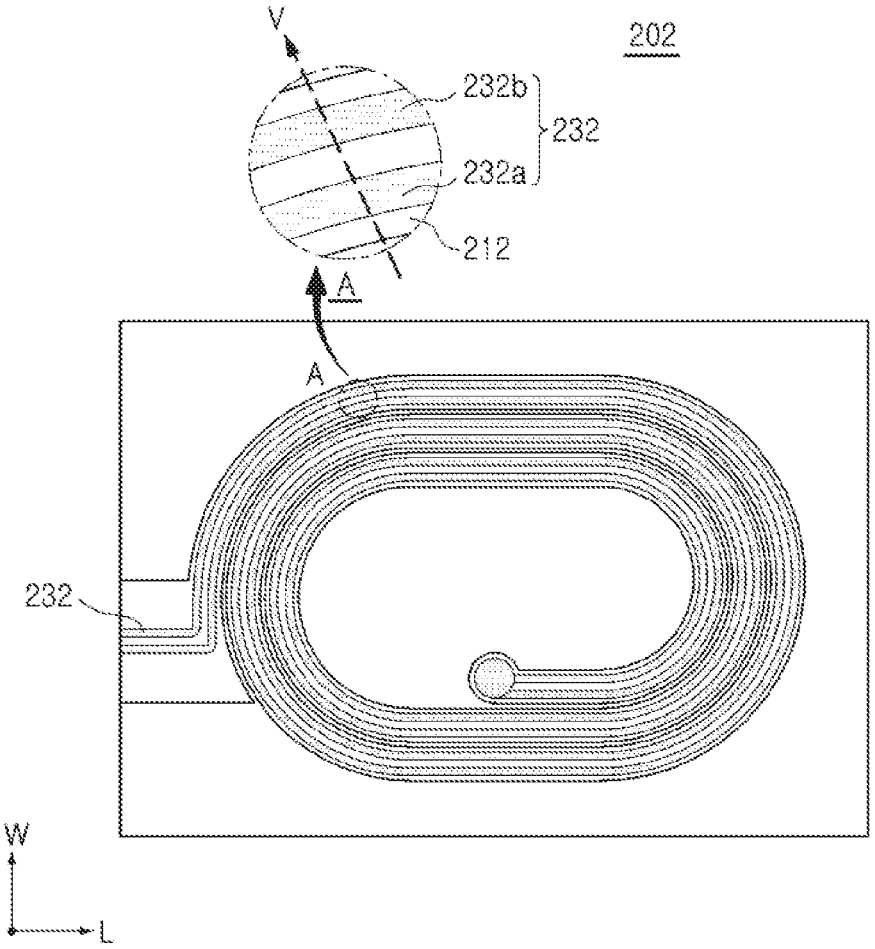
FIG. 9 is a cross-sectional view of a coil component according to a second modification of FIG. 6.

FIG. 9 is a top view of a coil component 202 according to a second modification to the coil component 200. The coil component 202 of FIG. 9 is substantially the same as the coil component 200 described above with reference to FIGS. 6 and 7, except for the amount of concave portions, and thus, for the purposes of description, the same reference numerals are used for the same components and a description of the same components will be omitted.

Referring to FIG. 9, a concave portion 232 formed on the upper surface of the coil 212 of the coil component 202 is formed in a plurality of rows in a direction V perpendicular to the winding direction of the coil 212. The concave portion 232 includes a first concave portion **232*a* adjacent to an innermost coil pattern and a second concave portion 232*b* adjacent to an outermost coil pattern. When the concave portion is formed in a plurality of rows, a large line width of the in-coil coil pattern of the coil 212** is advantageous. This means that it is easy to apply a coil component having a large line width of a coil pattern particularly for a coil component advantageous for a high frequency.

Figure 10:
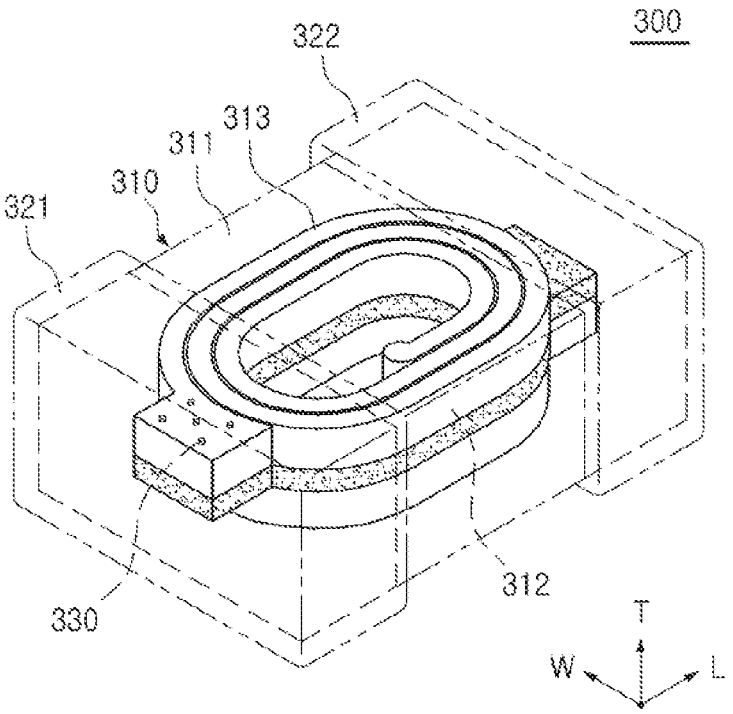
FIG. 10 is a schematic perspective view of a coil component according to a third exemplary embodiment in the present disclosure.

FIG. 10 is a perspective view of a coil component 300 according to a third exemplary embodiment in the present disclosure. The coil component 300 according to the third exemplary embodiment is substantially the same as the coil component 100 according to the first exemplary embodiment, except that a plurality of protrusions 330 are provided in lead portions of the coil.

Since the lead portions of outer surfaces of a coil are in contact with external electrodes, a line width thereof is generally adjusted to be large, relative to the coil main body, in order to reduce contact resistance. Thus, since the surfaces of the lead portions have a relatively large surface area, adding the plurality of protrusions to the surfaces of the lead portions is facilitated.

In addition, when the protrusions 330 are formed on the lead portions, a problem of over-plating of the lead portions as unintended side effects in a coil formation process may be solved. In case where the line width of the lead portions is relatively large, an excessive plating growth may occur frequently in the lead portions. Here, a plating scattering defect may occur, but this problem may be solved by applying a method such as etching to remove a formed coil, or the like, when a plurality of protrusions are formed.

Figure 11:
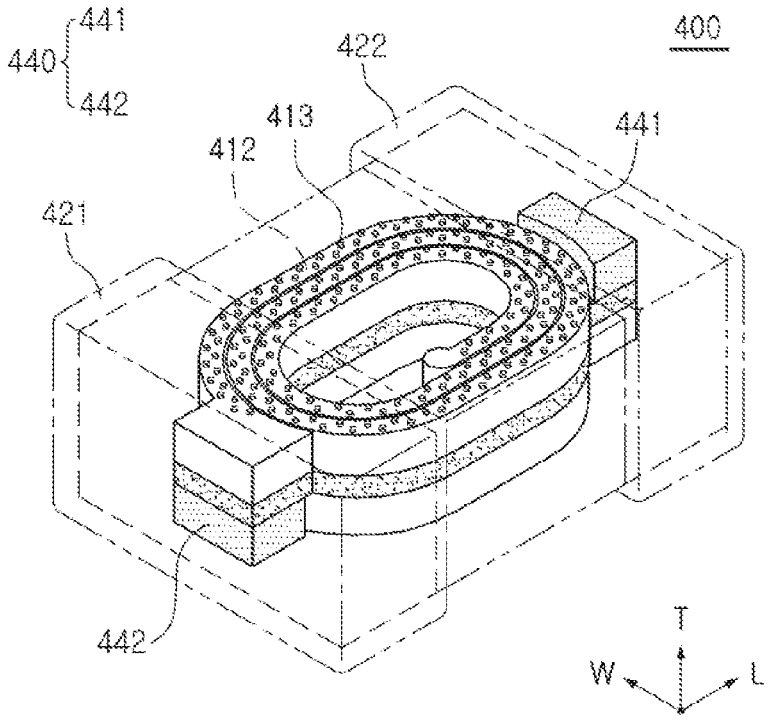
FIG. 11 is a schematic perspective view of a coil component according to a fourth exemplary embodiment in the present disclosure.
Figure 12:
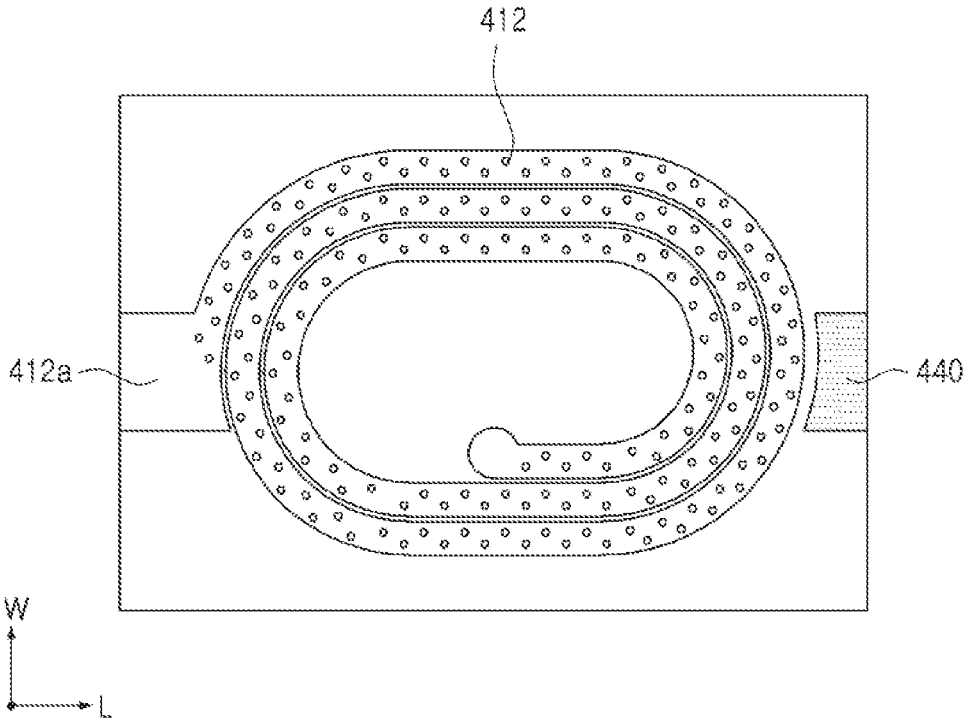
FIG. 12 is a top plan view of a coil of FIG. 11.

FIG. 11 is a schematic perspective view of a coil component 400 according to a fourth exemplary embodiment in the present disclosure, and FIG. 12 is a top plan view of a coil of the coil component of FIG. 11.

Referring to FIGS. 11 and 12, the coil component 400 further includes a dummy electrode 440 in the coil component 100 of FIG. 1. The dummy electrode 440 is electrically and physically spaced apart from the coil 412 but may be in physical contact with external electrodes 441 and 442. Since one edge of the dummy electrode 440 is in contact with the external electrodes 441 and 442, a possibility in which the external electrodes 421 and 422 are short-circuited from the body may be reduced. Since the dummy electrode 440 is in contact with the external electrodes 441 and 442, the dummy electrode 440 may advantageously include the same material as that of a material of an innermost side of the external electrodes 421 and 422 to strengthen contact properties.

The dummy electrode 440 may serve as a surface area increasing portion of the coil 412. Here, an arrangement of a dielectric layer to cover a surface of the dummy electrode 440 may further increase the SRF of the coil component 400. In addition, an application of an insulating material covering the coil, as well as the dielectric layer, to the surface of the dummy electrode 440 may also increase the SRF of the coil component 400.

Although the dummy electrode 440 is illustrated as including both a first dummy electrode 441 connected to the first external electrode 421 and a second dummy electrode 442 connected to the second external electrode 422, but the present disclosure is not limited thereto and only one of the first and second dummy electrodes 441 and 442 may be included.

The coil component described above includes the surface area increasing portion on the surface of the coil to have a desired SRF value, and is particularly advantageous for improving high frequency characteristics in a high frequency power inductor.

As set forth above, according to exemplary embodiments of the present disclosure, a power inductor which easily copes with a high current (Isat), controls an SRF, and has a high impedance Z in the vicinity of SRF may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body including a coil including lead portions at both ends thereof and a magnetic material sealing the coil; and external electrodes disposed on outer surfaces of the body and connected to the lead portions, respectively, wherein an outer surface of the coil including at least one of an upper surface, a lower surface, and a side surface of the coil which is uneven, the uneven surface includes a surface area increasing portion, and the surface area increasing portion includes a plurality of protrusions.

2. The coil component of claim 1, wherein the outer surface of the coil, excluding portions in contact with the external electrodes, is covered by an insulating material.

3. The coil component of claim 1, wherein the surface area increasing portion is disposed on the lead portions of the coil.

4. The coil component of claim 1, wherein the plurality of protrusions have the same appearance and the plurality of protrusions having the same appearance are repeatedly arranged.

5. The coil component of claim 1, wherein the plurality of protrusions have a sectional area narrowed toward an upper surface thereof.

6. The coil component of claim 1, wherein the plurality of protrusions are formed of the same material as that of the coil.

7. The coil component of claim 1, wherein the plurality of protrusions include a material different from that of the coil.

8. The coil component of claim 1, wherein the surface area increasing portion further includes a concave portion depressed from the surface of the coil.

9. The coil component of claim 8, wherein the concave portion is arranged to extend in a direction in which the coil is wound.

10. The coil component of claim 8, wherein the concave portion has a meandering shape.

11. The coil component of claim 8, wherein the concave portion extends along the shape of the coil.

12. The coil component of claim 8, wherein the concave portion is formed in a plurality of rows arranged to be parallel to each other in a direction perpendicular to the direction in which the coil is wound.

13. The coil component of claim 1, wherein the magnetic material includes a composite including a metal and a resin.

14. The coil component of claim 1, wherein the body includes a dummy electrode, the dummy electrode is physically spaced apart from the coil, and a portion of the dummy electrode is exposed to an outer surface of the body so as to be in contact with the external electrodes.

15. The coil component of claim 13, wherein at least a portion of a surface of the dummy electrode is covered by an insulating material.

16. A coil component comprising:

a body;

external electrodes disposed on an external surface of the body;

a coil having a coil pattern and lead portions respectively extending from ends of the coil pattern, the coil being enclosed in the body such that the lead portions are respective connected to the external electrodes;

an insulating material disposed to be in contact with an outer surface of the coil except on a portion of lead portions that is in contact with the external electrodes; and contact area increasing structures disposed on at least a portion of the outer surface of the coil, the contact area increasing structures being configured to increase an area of contact between the coil and the insulating material, wherein the contact area increasing structures comprise protrusions disposed on the outer surface of the coil, and the protrusions are spaced apart from each other in a winding path, from one of the ends of the coil pattern to another of the ends of the coil pattern, of the coil pattern.

17. The coil component of claim 16, wherein the contact area increasing structures further comprise indentations provided on the outer surface of the coil.

18. The coil component of claim 16, wherein the body further comprises a dummy electrode physically spaced apart from the coil, wherein a portion of the dummy electrode is exposed to an outer surface of the body so as to be in contact with the external electrodes.

19. The coil component of claim 16, wherein the body includes a magnetic material sealing the coil.

20. The coil component of claim 1, wherein the protrusions are spaced apart from each other in a winding path from one end to another end of a coil pattern disposed between the lead portions.

* * * * *